US007216385B2

(12) United States Patent
Hill

(10) Patent No.: US 7,216,385 B2
(45) Date of Patent: May 15, 2007

(54) INFLATABLE CUSHION APPARATUS FOR USE IN SURGICAL PROCEDURES AND SURGICAL METHOD UTILIZING THE SAME

(76) Inventor: Benjamin P. Hill, 1591 Garland St., Lakewood, CO (US) 80215

( * ) Notice: Subject to any disclaimer, the term of this patent is extended or adjusted under 35 U.S.C. 154(b) by 46 days.

(21) Appl. No.: 11/160,902

(22) Filed: Jul. 14, 2005

(65) Prior Publication Data

US 2006/0010602 A1 Jan. 19, 2006

Related U.S. Application Data

(60) Provisional application No. 60/588,293, filed on Jul. 14, 2004.

(51) Int. Cl.
*A61G 13/00* (2006.01)
*A61G 13/12* (2006.01)

(52) U.S. Cl. ..... 5/624; 5/621; 5/655.3; 128/845

(58) Field of Classification Search ..... 5/624, 5/648, 621, 655.3, 600, 1; 128/845, 846
See application file for complete search history.

(56) References Cited

U.S. PATENT DOCUMENTS 4,398,707 A * 8/1983 Cloward ..... 5/632
4,662,619 A * 5/1987 Ray et al. ..... 5/624
4,840,362 A 6/1989 Bremer et al.
5,014,375 A * 5/1991 Coonrad et al. ..... 5/648
5,088,706 A 2/1992 Jackson
5,131,106 A * 7/1992 Jackson ..... 5/613
5,239,716 A 8/1993 Fisk
5,444,882 A * 8/1995 Andrews et al. ..... 5/618
5,497,520 A * 3/1996 Kunz et al. ..... 5/648
6,076,525 A 6/2000 Hoffman
6,557,197 B1 5/2003 Graham

* cited by examiner

*Primary Examiner*—Alexander Grosz
(74) *Attorney, Agent, or Firm*—Timothy J. Martin; Michael R. Henson; John W. Carpenter

(57) ABSTRACT

An inflatable cushion for use in a system and method in supporting the knees and legs of a person during surgery included an inflatable bladder that can move from a collapsed state to an expanded state. A bladder port communicates with a source of inflating gas. The system includes the source of pressurized gas and a valve assembly to switchably control the inflation and deflation of the bladder. The bladder may have a removable cover extending around the bladder, and the bladder may have side pleats to assist in expanding with the cover having corresponding accordion folds. The method involves placing a patient on a surgical table, decompressing the patient's spine to a flat back/drop knee position, interposing the bladder between the table and the patient's knees and advancing the knees to a full prone position by inflating the bladder.

8 Claims, 3 Drawing Sheets

INFLATABLE CUSHION APPARATUS FOR USE IN SURGICAL PROCEDURES AND SURGICAL METHOD UTILIZING THE SAME

This application claims the benefit of U.S. Provisional Application No. 60/588,293, filed on Jul. 14, 2004.

FIELD OF THE INVENTION

The present invention broadly relates to surgical appliances and supports. More particularly, the present invention relates to apparatus and methods for conducting surgery on the human body. The exemplary embodiments teach a support apparatus and surgical methods incorporating the same used to conduct spinal surgery on a human patient.

BACKGROUND OF THE INVENTION

Since prehistoric times, treatment of human illness and injury has been a factor of human life. Many remedies, whether applied topically or taken by ingestion, were derived from plants or other animals. Broken bones were treated by binding the area to rigid supports, such a splints, casts and the like.

Historically, the success of the treatment of an illness or injury often depended upon its severity. At different points in time, certain illnesses were virtually untreatable resulting in a high fatality rate. Indeed, there are still classes of illnesses today which do not readily respond to known treatments. Likewise, medical personnel at certain historical points in time did not know how to treat conditions such as heart attacks, strokes and the like. The same was true for serious injuries, such as skull fractures, broken necks, etc.

There have been astounding medical advances, however, over the last hundred years, and the advent of new medical procedures and techniques has increased the quality of human life. These advances have occurred in all aspects of medical treatment, and advances are developing at an even accelerated rate. Giant strides have been made in diagnostic equipment to determine the nature of an illness or injury, in procedural techniques to deal with the illness or injury, in pharmaceuticals to treat the illness or injury, and in rehabilitative therapies.

One field of advanced surgery is that performed on the human back, namely, the spine. Surgery on the spine is usually performed in either the lateral recumbent or the prone position. The prone position originally involved the patient being laid recumbent with his/her abdomen on the surface of the operating table. Several disadvantages were present, though, when patients are simply laid face down on the operating surface. For example, it was learned that profuse bleeding could occur due to pressure on the interior vena cava. In addition, having the patient's upper legs generally in line with the torso (the "full prone position") places compression on the individual vertebra due to the curvature of the spine.

It was learned, then, that blood loss could be reduced by supporting the patient in a prone position with the abdomen pendulous and free. Second, it was learned that elevating the torso relative to the legs with the upper leg inclined at an angle to the torso helped decompress the spinal nerves. This decompression further helped separate the posterior elements of the spinal vertebrae to facilitate any surgery thereon. This position has been referred to as the "flat back/drop knee position".

In response, numerous devices have been developed to position the human body for back surgery. Significant among these is what is referred to as the "Jackson spinal table" which is depicted in U.S. Pat. No. 5,088,706 issued Feb. 18, 1992 to Jackson. This table allows a patient to be initially positioned in a supine position and then rotated so as to be supported by a prone position by a support structure. The support structure is formed by a plurality of lateral pads which elevate the torso relative to the legs so that the upper leg is inclined thereby decompressing the spine. Since the support pads are posts formed by an open channel, the abdomen is pendulous and free thus helping to reduce bleeding from the surgery. The lower legs are supported on a leg rest in the form of a fabric sleeve or platform extending across the table. Other devices for supporting the torso with the legs inclined for spinal surgery are disclosed in the following patents:

| Patent No. | Issue Date | Inventor |
|---|---|---|
| 4,840,362 | Jan. 20, 1989 | Bremer et al. |
| 5,239,716 | Aug. 31, 1993 | Fisk |
| 6,076,525 | Jun. 20, 2000 | Hoffman |

In addition to these patents disclosing structures for spinal surgery, U.S. Pat. No. 6,557,197 issued May 6, 2003 to Graham discloses a support pillow for rectal surgery wherein the torso is elevated relative to the legs.

A problem has arisen, however, when spinal fusion surgery is performed on a patient in the prone position having his/her torso elevated relative to the legs. Namely, when a patient's lumbar spine is fused in the flat back/drop knee position, the patient's sagittal balance may be affected after healing because the fused vertebrae pitch the patient more forwardly.

Therefore, after initial decompression of the spine in the initial surgery, but prior to fusion, it is known to return the patient's legs to the full prone position with the legs linearly aligned with the torso so that the lumbar spine is placed in a more natural curvature before fixation and fusion of the vertebrae. This procedure, however, is not without risk. To accomplish this procedure, a medical personnel typically enters the space underneath the patient to manually lift the patient's knees. Usually, though, this space is replete with neuro-monitoring equipment. This manual procedure can dislodge wires, tubes or other elements of the monitoring equipment risking disruption of the monitoring of the patient's condition. Moreover, there is attendant danger in an abrupt movement of the patient's knees during recompression of the spine. It is more preferable to raise the patient's legs very gradually; however, manually raising the legs in a gradual manner is difficult.

Accordingly, there remains a need for adjunct equipment which may facilitate the positioning of a patient during spinal surgery. There is a further need for apparatus and methods wherein a patient may be initially positioned in a prone position in the flat back/drop knee position who had subsequently moved, in a gradual manner, into the fully prone position prior to spinal fusion. Thus, there remains a need for improved apparatus and methods for conducting spinal surgery. The disclosed embodiments of the present invention are directed to meeting such needs.

SUMMARY

In one aspect, the exemplary embodiment of the inflatable cushion and the system of the present invention provides a new apparatus that is useful in positioning a patient during surgery, especially during spinal surgery.

An aspect of the exemplary method provides a method of conducting spinal surgery.

Another aspect of the exemplary embodiment of the inflatable cushion and the method allows the legs of a patient undergoing spinal surgery to be initially positioned in a flat back/drop knee position yet allows the legs subsequently to be advanced in a gradual manner to the full prone position or any intermediate position according to the preference of the surgeon.

It is yet another aspect of the exemplary embodiment to provide an apparatus for positioning a patient during spinal surgery that is easy to operate with less risk of injury to the patient.

According to the exemplary embodiment of the present invention, then, an inflatable cushion is disclosed which is adapted to be supported on a surgical table for use in supporting the knees and legs of a person during surgery. In this exemplary embodiment, the inflatable cushion includes a bladder that has a bottom wall, a top wall, and a surrounding sidewall extending therebetween. The bladder has a generally sealed interior adapted to receive an inflating gas thereby to expand from a collapsed state to an expanded state. The top wall and the bottom wall are generally parallel to one another with the sidewall being pleated so that the bottom wall and the top wall remain generally parallel to one another as they expand from the collapsed state to the expanded state. A bladder port is in fluid communication with the interior of the bladder so that the inflating gas may be introduced into the interior. A removable cover receives the bladder through an opening with the cover extending around the bladder when the bladder is received therein.

In the exemplary embodiment, the bladder is substantially parallelepiped in shape when in the expanded state. Further, it may be capable of expanding to about ten to twelve inches in height when in the expanded state, and, when in the collapsed state, may be generally square-shaped, although other shapes are contemplated. The cover may have a bottom panel, a top panel and a side panel respectively confronting the bottom wall, the top wall and the surrounding sidewall of the bladder when the bladder is received therein. The side panel may include one or more accordion folds, if desired. The cover may have a closure for the opening, with this closure being hook and loop fasteners, zippers, snaps and the like.

The exemplary embodiment also relates to a system for use during surgery in order to selectively position a person's knees and legs on a surgical table between a flat back/drop knee position and a full prone position. This system includes a bladder, such as that described above. A source of pressurized gas is provided, and a valve assembly is also provided. This valve assembly is in fluid communication with the source of pressurized gas and with the bladder. The valve assembly also has an exhaust port. The valve assembly is switchable between a filled state wherein the inflating gas is supplied to the bladder and an exhaust state wherein inflating gas may be exhausted from the bladder.

A gas regulator may be associated with the valve assembly with this gas regulator operative to control the pressure of the inflating gas. Also, valve actuator that are actuated by the surgeon's foot, may be used to control the valve assembly. Optionally, a vacuum source may be connected to the exhaust port of the valve assembly to assist in exhausting gas from the bladder.

According to the exemplary embodiment, a method is also provided for positioning a patient during spinal surgery wherein the patient may be moved from a flat back/drop knee position toward a full prone position. This method includes placing the patient on a surgical table and decompressing this patient's spine by moving the patient into a flat back/drop knee position. An inflatable bladder is interposed in a collapsed state between a portion of the surgical table and the patient's knees. The method then includes the step of inflating the bladder at a selected time and over a selected interval from the collapsed state to an expanded state so as to advance the patient's knees to an elevated first location corresponding to the full prone position.

According to the method, the selected interval may be in a range of about one to twenty minutes, although in most procedures, a range of about one to two minutes is sufficient. More gradual inflation may optionally be provided over a range of about ten to twenty minutes.

The step of advancing the patient's knees and body from the flat back/drop knee position toward the full prone position is desirably accomplished while maintaining the knees in a substantially common horizontal plane. This step may also be accomplished through at least one intermediate location between the flat back/drop knee position and the elevated first location. The method then maintains the patient's knees at the intermediate stage for a selected duration of time. The method may also include the step of deflating the bladder to advance the patient's knees and body from the elevated first location position back to the flat back/drop knee position. The step of deflating the bladder is accomplished by evacuating the bladder either to the ambient environment or assisted through a vacuum source.

DETAILED DESCRIPTION OF THE EXEMPLARY EMBODIMENTS

The present invention generally relates to surgical apparatus and techniques. More particularly, however, the exemplary embodiment discloses a support apparatus that may be used in surgical procedures, such as spinal surgeries. Thus, an aspect of the exemplary embodiment contemplates a method of performing such a surgery utilizing the support apparatus of the present invention. Generally, the apparatus of the present invention is directed to an inflatable cushion that may be used to elevate the knees and legs of a patient during spinal surgery so as to gradually shift the patient from a flat back/drop knee position to a full prone position.

As used herein, the "flat back/drop knee position" refers to a position wherein the patient's torso is generally horizontal and elevated with respect to the legs and knees so that the upper leg forms an angle with the torso thereby to decompress the spine. The "full prone position" means that the patient is generally in a horizontal position with the torso and legs generally in a linear orientation. In this full prone position, the abdomen may still be pendulous and free.

Figure 1:
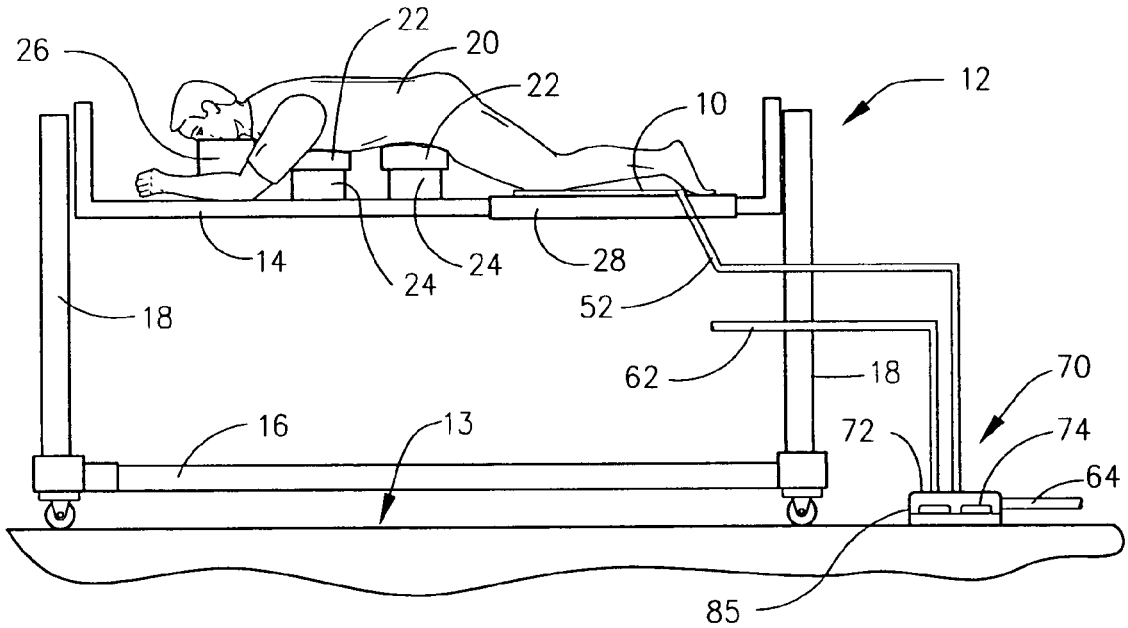
FIG. 1 is a side view in elevation diagramming a Jackson table with a patient shown positioned thereon in a flat back/drop knee position with a positioning apparatus according to the exemplary embodiment of the present invention positioned beneath the patient's knees.
Figure 2:
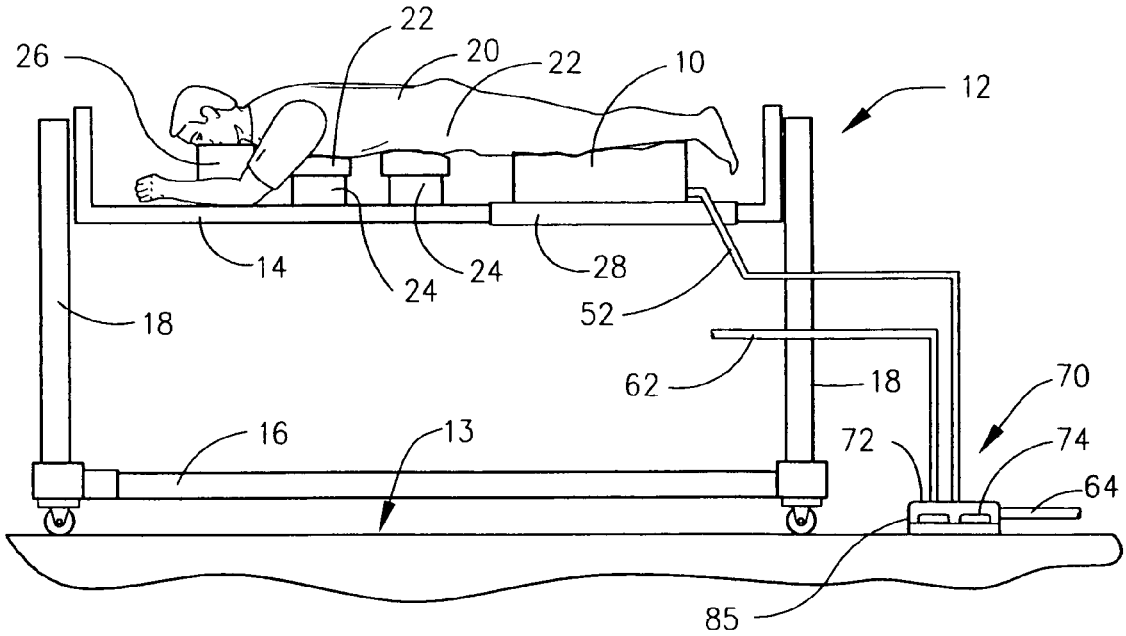
FIG. 2 is a side view in elevation, similar to FIG. 1, but showing the present invention in an expanded state to raise the person's knees and legs into the full prone position.
Figure 3:
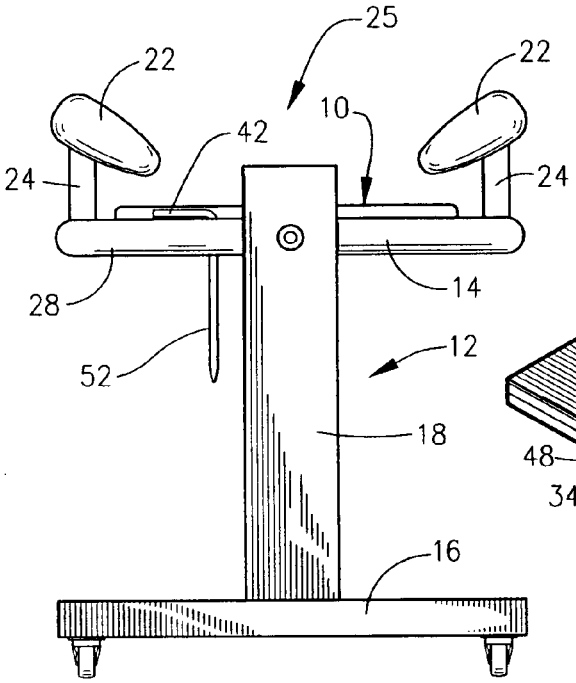
FIG. 3 is an end view in elevation of the Jackson table of FIG. 1 (without a patient) showing the positioning of the patient support according to the present invention, in a collapsed state, along with the monitoring equipment therefore.

The present invention is introduced in FIGS. 1–3 wherein the inflatable cushion 10 is shown in conjunction with a Jackson spinal table 12 of the type known in the art resting on a support surface 13, such as the floor of an operating room. The Jackson spinal table 12 includes a generally rectangular and open patient support frame 14 that is rotatably mounted on an expandable framework 16 by uprights 18 that may include hydraulic lifts. As is known in the art, support frame 14 may rotate so as to allow the patient to be first positioned in a supine position and then rotated to a prone position.

In FIG. 1, patient 20 is illustrated in the traditional "flat back/drop knee position". Here, a plurality of support pads 22 are supported on brackets in the form of posts 24 so that a V-shaped channel 25 is formed, as is illustrated in FIG. 3. Support pads 22 support the torso of the body so that the abdomen can hang pendulous and free. A head support cushion 26 supports the head of the patient 20 while a fabric sleeve 28 extends transversely across patient support frame 14 in order to support the knees and legs of the patient. This structure, as indicated, is a standard back surgery table commonly used at the time of this application.

As indicated in the background discussion of this invention, it is often desirable that surgery on a patient begin with the patient in the flat back/drop knee position shown in FIG. 1. This decompresses the spine in order to take pressure off the spinal nerves and to free the vertebrae thus facilitating surgery thereon. However, it is also known during the course of the surgical procedure that it may be desirable to move the patient from the flat back/drop knee position to a full prone position such as shown in FIG. 2. As is illustrated in these two figures, the inflatable cushion 10 of the exemplary embodiment may be moved from a collapsed state shown in FIG. 1 to an expanded state shown in FIG. 2. This expansion moves the patient the flat back/drop knee position to the full prone position shown in FIG. 2 in a controlled manner.

Figure 4:
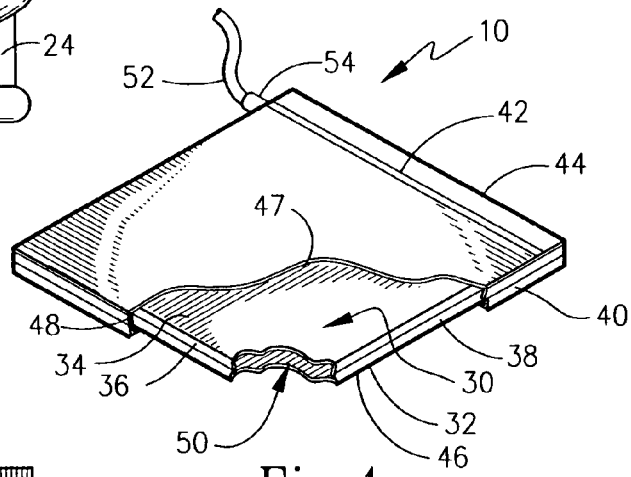
FIG. 4 is a perspective view, partially broken away, showing the inflatable support according to the exemplary embodiment of the present invention that is used to practice the surgery method described herein with the inflatable support being shown in a collapsed state.
Figure 5:
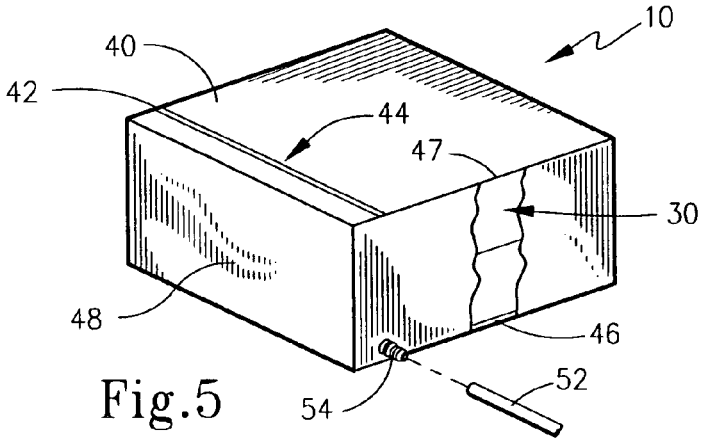
FIG. 5 is a perspective view, partially broken away, showing the inflatable support according to the exemplary embodiment of the present invention that is used to practice the surgery method described herein with the inflatable support being shown in an expanded state.

Inflatable cushion 10 is illustrated in greater detail in FIG. 4 (collapsed state) and in FIG. 5 (expanded state). The movement of the inflatable cushion 10 between the collapsed state and the expanded state, through an intermediate state, is further illustrated in FIGS. 6(*a*)–6(*c*). In these Figures, the inflatable cushion 10 is generally square-shaped in configuration when collapsed and takes on a parallelepiped shape when expanded. It should be understood that inflatable cushion 10 can take any geometric shape as desired, but it is helpful if the bottom and top walls are generally parallel in the collapsed state and remain generally parallel during expansion to the expanded state.

Inflatable cushion 10 includes an inner bladder 30 that has a bottom wall 32, a top wall 34 and a surrounding side wall 36 extending therebetween. Side wall 36 is pleated at 38. A suitable covering 40 extends around bladder 30 so as to receive and encase bladder 30 therein. Covering 40 includes a bottom panel 46, a top panel 47 and a surrounding side panel 48 that respectively confront bottom wall 32, top wall 34 and side wall 36 when bladder 30 is received therein. Covering 40 also is provided with an access opening 42 for the insertion and removal of bladder 30 into the interior of covering 40. Access opening 42 may be provided with a closure 44 of any suitable type, such as Velcro, snaps, zipper and the like. Bladder 30 has a generally sealed interior 50 that is in fluid communication with conduit 52 by way of any suitable connector, such as nipple 54. Nipple 54 thus forms a bladder port that allows pressurized gas to be introduced into bladder 30 by way of conduit 52 so that bladder 30 can be inflated to move it from the collapsed state and the expanded state. Nipple 54 and conduit 52 also allow gas to evacuate from bladder 30 so as to allow it to deflate from the expanded state. When in the collapsed state, the inflatable cushion 10 should be as thin as possible, but the thickness is not critical. Moreover, it is desirable that the inflatable cushion 10 is capable of expansion to a thickness of about ten to twelve inches thick.

Figure 6A:
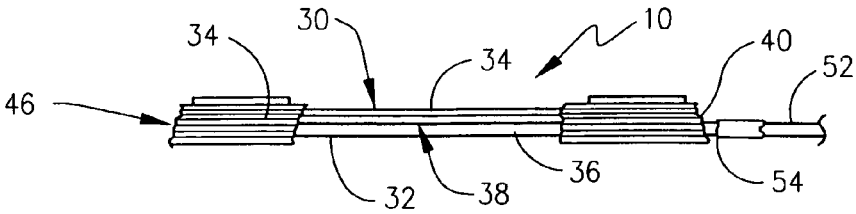
FIGS. 6(*a*), 6(*b*) and 6(*c*) are, respectively, side views in elevation, partially broken away, of the support shown in FIG. 4 respectively in a fully collapsed, intermediate and fully expanded states.
Figure 6B:
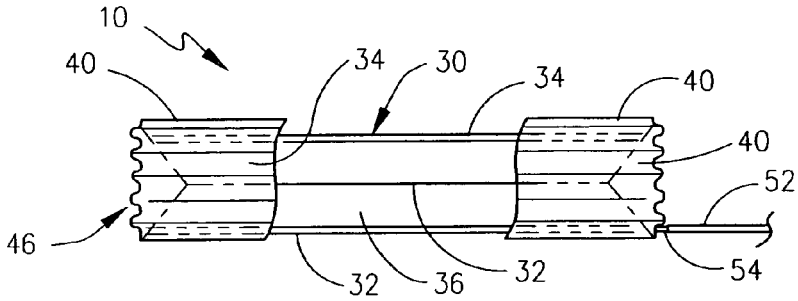
Figure 6C:
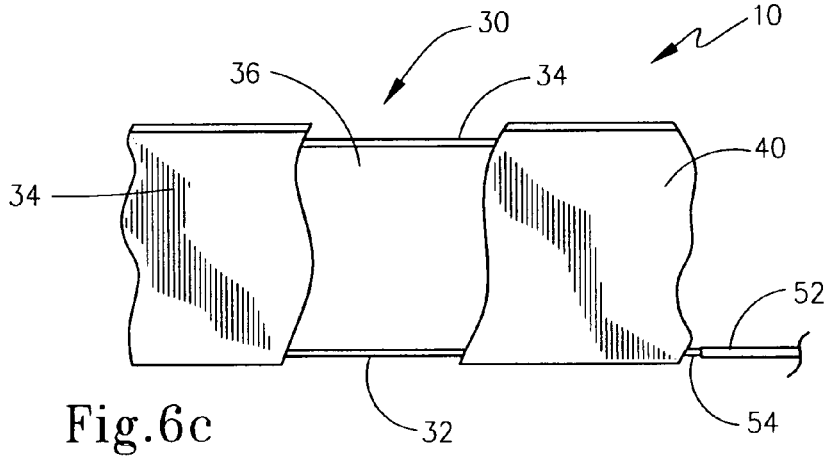

Bladder 30 is constructed of any convenient flexible material such as plastic, rubber or the like. Cover 40 may be a cloth, foam or other material which may be removed from bladder 30 either for cleaning or disposal. Bladder 30 is pleated to allow expansion. Likewise, cover 40 may be provided with accordion folds 46 to accommodate expansion of bladder 30. With reference to FIGS. 6(*a*)–6(*c*), it may be seen that, as a pressurized gas is introduced into bladder 30 through conduit 52, inflatable cushion 10 moves from the fully collapsed state shown in 6(*a*) to a fully expanded state, shown in FIG. 6(*c*) through an intermediately filled state shown in FIG. 6(*b*).

Figure 7:
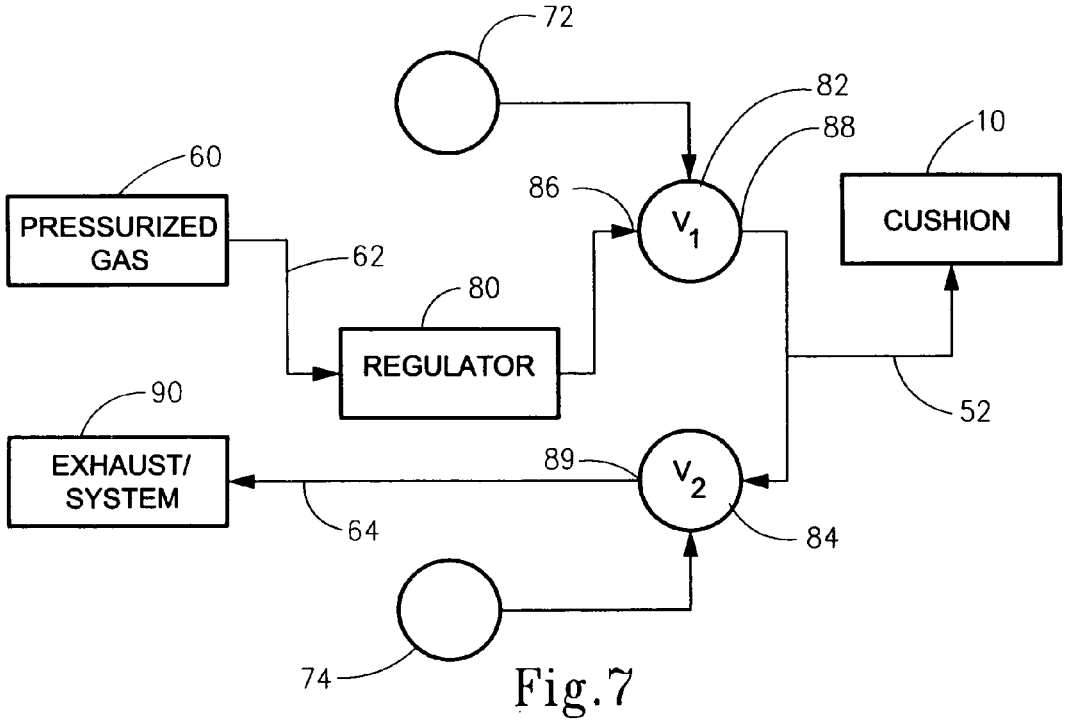
FIG. 7 is a diagram of the support system according to the present invention.

With reference to FIGS. 1–2 and to the diagram of the system in FIG. 7, it may be appreciated that inflatable cushion 10 may be inflated from the collapsed state to the expanded state by means of a source of pressurized gas 60 which supplies gas through conduit 52 through a regulator 80. The source of pressurized gas 60 can be any convenient source and any convenient gas that may be available in an operating facility. For example, the pressurized gas may be nitrogen, oxygen or any other gas that is normally available, in a pressurized condition in an operating room. Alternatively, this source could be an individually pressurized tank of gas or air or even an air compressor or the like.

In any event, pressurized gas is available to regulator 80 by means of conduit 62, and regulator 80 has a valve assembly, for example, having a first valve 82 and a second valve 84 associated therewith. Regulator 80 and valves 82 and 84 may conveniently be located in a common enclosure 85. The valve assembly has a first port 86 in fluid communication with the source of pressurized gas and a second port 88 in fluid communication with the bladder port. Valves 82 and 84 are normally biased in a closed condition so as to prevent passage of gas therethrough.

Foot operable valve actuators 72 and 74 are provided for valves 82 and 84, respectively, and are located on enclosure 85. Upon operation of the first valve actuator 72, valve 82 is moved to an open condition so that gas is supplied from regulator 80 at a desired pressure and flow rate so at to inflate inflatable cushion 10. This flow rate may be adjusted and valve actuator 72 may be used to control the gradual inflation of inflatable cushion 10 and thus the gradual movement of the patient from the flat back/drop knee position toward the fully prone position. When it is desired to deflate inflatable cushion 10, the second valve actuator 74 may be activated so that valve 84 opens thus allowing the gas to be exhausted through an exhaust port 89 by way of conduit 64, illustrated in FIG. 1-2 and 7. The exhaust of the gas may simply be to the ambient environment, but may optionally be facilitated by connecting conduit 64 to a vacuum source 90.

From the foregoing, it should be appreciated that the inflatable cushion 10 according to this invention may be used with a surgical method, such as a spinal surgery. Here, the method includes a first step of placing a patient on a surgical table and decompressing the patient's spine by moving the patient into a flat back/drop knee position. The method includes the step of placing an inflatable cushion between a portion of the surgical table and the patient's knees. Subsequently, an initial target surgical procedure is performed on the patient's back while the patient is in the flat back/drop knee position. Thereafter, the method includes the step of inflating the inflatable cushion thereby to advance the patient's knees from the flat back/drop knee position to an elevated first location corresponding to the full prone position over a selected interval of time a selected by the surgeon. The phrase "corresponding to the full prone position" is meant to include the full prone position as well as positions that are below or above the full prone position but above the flat back/drop knee position.

The selected interval of time may desirably be in a range of about one to twenty minutes or more. Where a faster interval is desired, this range may be on the order of one to two minutes; however, even more gradual elevation over a period of ten to twenty minutes or more may be appropriate, depending upon the particular circumstances of the surgery. In any event, it is desirable that the knees are maintained in a substantially common horizontal plane during elevation.

Indeed, the apparatus and method of this exemplary embodiment can allow staging of the surgery at successive levels of elevation between the flat back/drop knee and full prone positions. In any event, after the patient is placed in the desired position, such as the full prone position or an intermediate position, additional surgical steps are performed. These additional surgical steps may include any known in the art, such as fusing a portion of the patient's spine, applying implantable appliances, fixation and the like.

Accordingly, the exemplary embodiment of the present invention present invention has been described with some degree of particularity. It should be appreciated, though, that modifications or changes may be made to the exemplary embodiments of the present invention without departing from the inventive concepts contained herein.

What is claimed is:

1. A method of positioning a patient during spinal surgery wherein the person may be moved between a flat back/drop knee position and a full prone position, comprising:

(A) placing the patient on a surgical table;

(B) decompressing the patient's spine by moving the patient into a flat back/drop knee position;

(C) interposing an inflatable bladder in a collapsed state between a portion of the surgical table and the patient's knees; and (D) advancing the patient's knees to an elevated location corresponding to the full prone position by inflating the bladder at a selected time and over a selected interval from a collapsed state toward an expanded state thereby to move the patient from the flat back/drop knee position toward a full prone position.

2. The method according to claim 1 wherein the selected interval is in a range of about one to twenty minutes.

3. The method according to claim 2 wherein the selected interval is in a range of about one to two minutes.

4. The method according to claim 2 wherein the selected interval is in a range of about ten to twenty minutes.

5. The method according to claim 1 wherein the step of advancing the patient's knees to the elevated first location is accomplished while maintaining the knees in a substantially common horizontal plane.

6. The method according to claim 1 wherein the step of advancing the patient's knees to the elevated first location is accomplished with there being at least one intermediate stage wherein the patient's knees are elevated at an intermediate location between the flat back/drop knee position and the elevated first location and maintaining the patient's knees at the intermediate location for a selected duration of time.

7. The method according to claim 1 including the step of deflating the bladder to advance the patient's knees and body from the elevated first location to the flat back/drop knee position.

8. The method according to claim 7 wherein the step of deflating said bladder is accomplished by evacuating said bladder by way of a vacuum source.

* * * * *